US012460429B2

(12) United States Patent
Golden

(10) Patent No.: US 12,460,429 B2
(45) Date of Patent: Nov. 4, 2025

(54) LINEAR SPACING SYSTEM

(71) Applicant: Nathan Charles Maurice Golden, Sioux Falls, SD (US)

(72) Inventor: Nathan Charles Maurice Golden, Sioux Falls, SD (US)

( * ) Notice: Subject to any disclaimer, the term of this patent is extended or adjusted under 35 U.S.C. 154(b) by 259 days.

(21) Appl. No.: 18/219,855

(22) Filed: Jul. 10, 2023

(65) Prior Publication Data

US 2025/0019980 A1 Jan. 16, 2025

(51) Int. Cl.
*E04F 21/00* (2006.01)

(52) U.S. Cl.
CPC ..... *E04F 21/0092* (2013.01)

(58) Field of Classification Search
CPC ..... E04F 21/0092
See application file for complete search history.

(56) References Cited

U.S. PATENT DOCUMENTS

2003/0226271 A1* 12/2003 Cordell ..... E04F 21/0092 33/526
2006/0260243 A1* 11/2006 Angelozzi, Jr. ..... B25B 5/145 52/506.05
2007/0214743 A1* 9/2007 Alvarez ..... E04F 21/0092 52/749.11
2007/0227025 A1* 10/2007 Venture ..... E04F 21/0092 33/527

FOREIGN PATENT DOCUMENTS

GB 2592920 A * 9/2021 ..... E04F 13/0862
KR 20100120061 A * 5/2009

* cited by examiner

*Primary Examiner* — Babajide A Demuren

(57) ABSTRACT

A linear spacer for creating a uniform spacing between a first tile unit and a second tile unit disposed on a foundation surface includes a body, one or more first through-holes extending through the body portion in a first direction substantially orthogonal to the longitudinal axis, and one or more second through-holes extending through the body portion in a second direction different than the first direction and orthogonal to the longitudinal axis. When the linear spacer is disposed in a gap between the first and second tile units, the linear spacer defines and maintains a linear spacing between the first tile unit and the second tile unit.

20 Claims, 10 Drawing Sheets

LINEAR SPACING SYSTEM

SUMMARY

In some aspects of the present description, a linear spacer for creating a uniform spacing between a first tile unit and a second tile unit disposed on a foundation surface (e.g., a wall, the ground, etc.) is provided, the linear spacer including a body portion, one or more first through-holes, and one or more second through-holes. The body portion includes a first end and a second end and at least one external side surface (e.g., one or more side surfaces) extending between the first end and the second end and substantially parallel to a longitudinal axis of the body portion. The one or more first through-holes extend through the body portion in a first direction substantially orthogonal to the longitudinal axis and extending from a first external opening on the at least one external side surface of the body portion to an opposing second external opening on the at least one external side surface of the body portion. The one or more second through-holes extend through the body portion in a second direction different than the first direction and orthogonal to the longitudinal axis and extending from a third external opening on the at least one external side surface of the body portion to an opposing fourth external opening on the at least one external side surface of the body portion. When the linear spacer is disposed in a gap between the first tile unit and the second tile unit such that the first external opening is substantially adjacent to a first edge of the first tile unit, the second external opening is substantially adjacent to a corresponding first edge of the second tile unit, the third external opening is adjacent the foundation surface, and the fourth external opening faces substantially away from the foundation surface, the linear spacer defines and maintains a linear spacing between the first tile unit and the second tile unit.

In some aspects of the present description, a linear spacing system is provided, the linear spacing system including two or more linear spacers of the present description and one or more connectors configured to align and connect the two or more linear spacers end-to-end to create an adjustable length linear spacer. The adjustable length linear spacer is configured to define and maintain a linear spacing between a first tile unit and a second tile unit, and a length of the adjustable length linear spacer is defined by a total length of the connected two or more linear spacers, and the length of the adjustable length linear spacer is greater than or equal to 50% of a length of the gap between the first tile unit and the second tile unit.

BACKGROUND OF THE INVENTION

Figure 1:
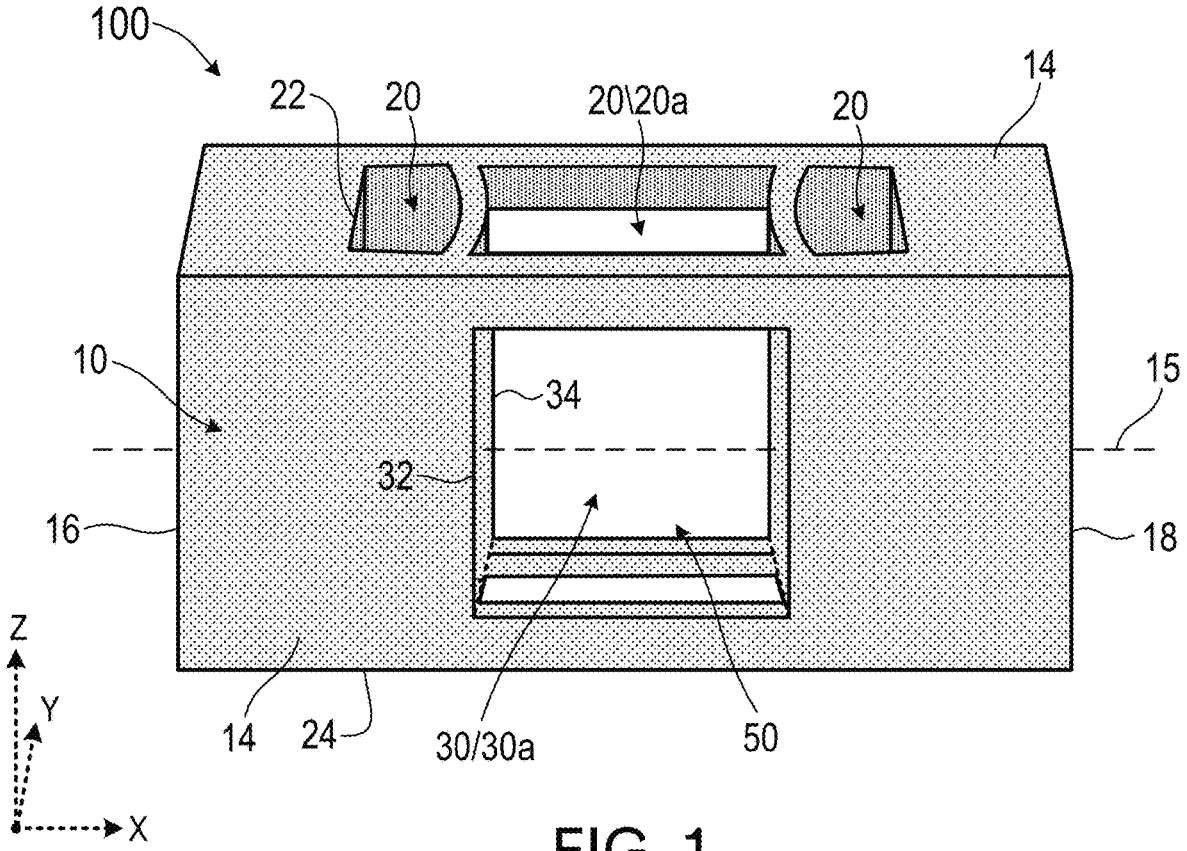
FIG. 1 is a perspective view of a linear spacer, in accordance with a first embodiment of the present description.

Existing methods used to space tile, natural stone, and natural stone pavers (herein collectively referred to as "tiles" or "tile units") typically include the steps of inserting desired-width spacers at the corner and intersections of the tile or pavers. This process is time-consuming and requires that multiple units are handled or adjusted frequently. Not only is it inefficient to insert the spacers, but they also often require readjustment and constant attention to maintain straight and square joints. The current system used in paver applications often leads to continual shifting of the tiles and spacers. This shifting is counterproductive, requiring a significant amount of rework. Stone pavers used in outdoor landscaping projects are typically quite large and must be walked on to lay subsequent courses, causing spacers to shift often or even go missing. What is needed in the art is a system to make the tiling process more efficient and consistent.

DETAILED DESCRIPTION

In the following description, reference is made to the accompanying drawings that form a part hereof and in which various embodiments are shown by way of illustration. The drawings are not necessarily to scale. It is to be understood that other embodiments are contemplated and may be made without departing from the scope or spirit of the present description. The following detailed description, therefore, is not to be taken in a limiting sense.

According to some aspects of the present description, a linear spacer for creating a uniform spacing between a first tile unit and a second tile unit disposed on a foundation surface (e.g., a wall, the ground, etc.) includes a body portion, one or more first through-holes, and one or more second through-holes. In some embodiments, the body portion includes a first end and a second end and at least one external side surface (e.g., one or more side surfaces) extending between the first end and the second end and substantially parallel to a longitudinal axis of the body portion (i.e., an axis passing through the body portion from the first end to the second end.

In some embodiments, the one or more first through-holes may extend through the body portion in a first direction substantially orthogonal to the longitudinal axis and extend from a first external opening on the at least one external side surface of the body portion to an opposing second external opening on the at least one external side surface of the body portion. In some embodiments, the one or more second through-holes may extend through the body portion in a second direction different than the first direction and orthogonal to the longitudinal axis and may extend from a third external opening on the at least one external side surface of the body portion to an opposing fourth external opening on the at least one external side surface of the body portion.

In some embodiments, when the linear spacer is disposed in a gap between the first tile unit and the second tile unit such that the first external opening is substantially adjacent to a first edge of the first tile unit, the second external opening is substantially adjacent to a corresponding first edge of the second tile unit, the third external opening is adjacent the foundation surface, and the fourth external opening faces substantially away from the foundation surface, the linear spacer defines and maintains a linear spacing between the first tile unit and the second tile unit. That is, when the linear spacer is disposed between and directly adjacent to (e.g., in contact with) the edges of a first tile unit and a second tile unit, the presence of the linear spacer holds the edges of the first tile unit and the second tile unit apart and does not allow the first tile unit and second tile unit to move toward each other.

In some embodiments, the linear spacer may be configured to be permanently embedded in a grout or similar material applied in the gap between the first tile unit and the second tile unit (i.e., permanently embedded between the tile units). In some embodiments, when the linear spacer is embedded in the grout, the grout may be at least partially disposed within the one or more first through-holes and in contact with the foundation surface (e.g., the wall being tiled, or the ground if the tile units are landscaping pavers, etc.) to which the first tile unit and second tile unit are disposed. In some embodiments, when the linear spacer is embedded in the grout, the grout may be at least partially disposed within the one or more second through-holes and in contact with the first edge of the first tile unit and the corresponding first edge of the second tile unit (e.g., that is, the grout may pass through the one or more second through-holes such that it is in contact with the adjacent/facing sides of the two tile units). When the linear spacer is embedded within the grout, and when a sufficient amount of grout material is disposed within the interior of the linear spacer (i.e., when the grout fills or partially fills the first and second through-holes), the linear spacer helps to maintain a uniform spacing between the first tile unit and the second tile unit by holding them in place (i.e., not allowing them to move away from each other due to the adhesive force of the grout material disposed within and around the linear spacer.)

In some embodiments, at least one of the one or more first through-holes may intersect at least one of the one or more second through-holes, such that the at least one first through-hole and the at least one second through-hole define a common open space within the body portion of the linear spacer. This common open space may be configured such that the grout material can enter in and at least partially fill the common opening. One purpose of such a common open space is to allow a larger amount of grout to be disposed within the linear spacer to ensure optimum adhesion between the two adjacent tiles and the linear spacer disposed between them.

In some embodiments, at least one of the one or more first through-holes may intersect (pass through) the longitudinal axis of the body portion. In some embodiments, at least one of the one or more second through-holes may intersect (pass through) the longitudinal axis of the body portion. In some embodiments, the second direction may be substantially orthogonal to the first direction.

In some embodiments, the linear spacer may be configured such that the length of the linear spacer substantially matches a length of the gap between the first tile unit and the second tile unit, or such that it substantially matches a length of the gap between a plurality of first tile units and a plurality of second tile units. For example, if a wall being tiled is 4 feet high, the linear spacer may have a length that substantially matches a gap between adjacent tiles that is about 4 feet long. That is, the linear spacer may have a length such that it provides and defines the spacing between a first plurality of tiles and a second plurality of tiles. In such an embodiment, when the linear spacer substantially covers/fills the length of the gap between two adjacent tile units, or between two adjacent pluralities of tile units, rather than being disposed only along one or two points along only a portion of the gap, the linear spacer can prevent rotation/skew of adjacent tiles relative to each other.

In some embodiments, the linear spacer may be a continuous, unitary member configured to match the length of a corresponding gap between tiles. In some other embodiments, at least one of the first end and the second end of the body portion may include an alignment feature (a connecting feature) which is configured to align and connect the linear spacer to a mating linear spacer. That is, in some embodiments, a longer linear spacer may be created by connecting two or more shorter linear spacers in an end-to-end fashion. In some embodiments, the alignment feature may be a hole in at least one of the first end and the second end of the body portion. In some embodiments, the hole may be configured to accept a connecting member configured to align the linear spacer with the mating linear spacer. In some embodiments, the connecting member may be a separate piece (e.g., a short rod) designed to be disposed in the hole of the linear spacer and a corresponding hole in the mating linear spacer. In some other embodiments, the connecting member may be a protrusion on and integral to an end surface of a mating linear spacer, the protrusion designed to be disposed in the hole of the linear spacer.

In the embodiments when the linear spacer is a single, longer piece (i.e., longer than is needed for a particular gap between tiles), the body portion may further include one or more score features. In some embodiments, the one or more score features may define locations where the body portion can be separated (e.g., easily snapped by hand or with a tool) to reduce an overall length of the linear spacer.

In some embodiments, the linear spacer may further have at least one depression in the at least one external side surface, wherein, when grout is applied between the at least one depression of the linear spacer and the foundation surface, grout is allowed to pass into the at least one depression. For example, an otherwise substantially planar surface of the linear spacer (e.g., a bottom surface) configured to be adjacent to or in contact with the foundation surface may include a concave surface or depression withing the substantially planar surface that allows an amount of grout to fill in the depression, creating adhesion between the foundation surface and the linear spacer (whereas a completely flat or planar surface with no depressions may not allow grout to be disposed between the foundation surface and the linear spacer).

In some embodiments, a cross-section of the body portion taken in a plane orthogonal to the longitudinal axis may have any appropriate shape, including but not limited to, a shape chosen from a group including a square, a rectangle, a circle, and oval, and a polygon.

In some embodiments, a length of the linear spacer may be defined by a distance between the first end and the second end, where the length is greater than or equal to about 50%, or greater than or equal to about 60%, or greater than or equal to about 70%, or greater than or equal to about 80%, or greater than or equal to about 90%, or greater than or equal to about 100%, or greater than or equal to about 110% of a length of the gap between the first tile unit and the second tile unit. In some embodiments, the length of the linear spacer may be greater than a gap between a first plurality of tile units and a second plurality of tile units (i.e., may be long enough to span a gap longer than a gap between just two adjacent tiles). In some embodiments, the length of the linear spacer may be defined by the distance between the first end and the second end of a single, integral linear spacer. In other embodiments, the length of the linear spacer may be defined by the total length of a plurality of shorter, connected linear spacer sections.

In some embodiments, a cross-section of the body portion taken in a plane orthogonal to the longitudinal axis has a substantially circular shape, and the one or more first through-holes and the one or more second through-holes may be arranged along a length of the linear spacer defined by a distance between the first end and the second end and oriented at a variety of angles with respect to one another and the longitudinal axis. Stated another way, in some embodiments, the linear spacer may be shaped as an extended cylinder with a plurality of through-holes passing through or near the longitudinal axis of the linear spacer at a variety of angles along the length of the extended cylinder. In some such embodiments, the linear spacer may further include a plurality of depressions (e.g., concave or otherwise recessed sections) in the at least one external side surface arranged at a plurality of different locations along the length of the linear spacer (allowing grout to enter into the depressions to improve the adhesion between the linear spacer and adjacent surfaces).

In some embodiments, a linear spacing system may include two or more of any of the linear spacers described herein and one or more connectors configured to align and connect the two or more linear spacers end-to-end to create an adjustable length linear spacer. In some such embodiments, the adjustable length linear spacer may be configured to define and maintain a linear spacing between the first tile unit and the second tile unit, and a length of the adjustable length linear spacer may be defined by a total length of the connected two or more linear spacers. In some such embodiments, the length of the adjustable length linear spacer may be greater than or equal to about 50%, or greater than or equal to about 60%, or greater than or equal to about 70%, or greater than or equal to about 80%, or greater than or equal to about 90%, or greater than or equal to about 100%, or greater than or equal to about 110% of a length of the gap between the first tile unit and the second tile unit.

Figure 4:
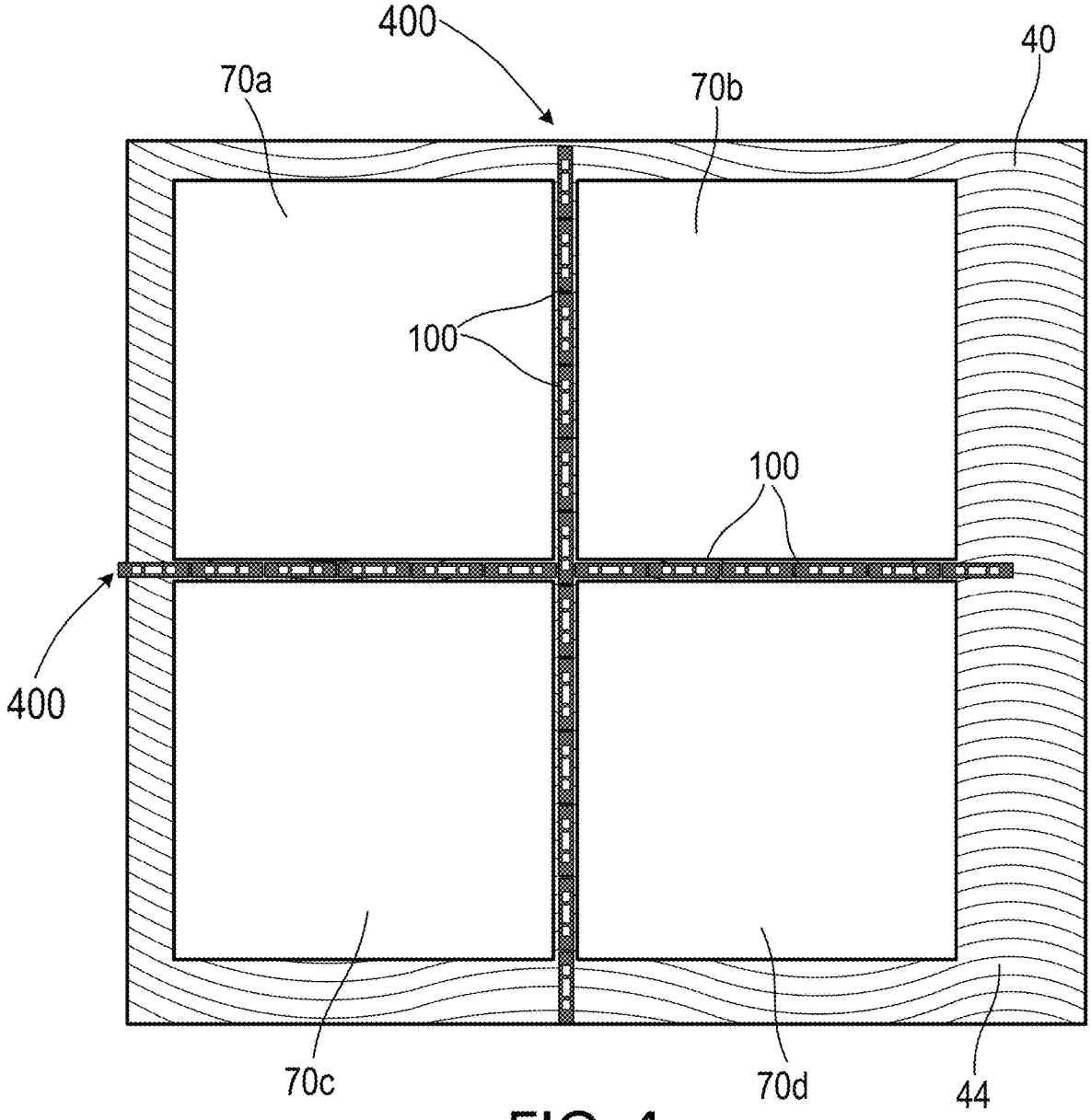
FIG. 4 is a schematic view of a linear spacing system creating uniform spacing between tiles on a foundation surface, in accordance with an embodiment of the present description.

Turning now to the figures, FIG. 1 is a perspective view of an embodiment of a linear spacer, according to the present description. In some embodiments, a linear spacer 100 for creating a uniform spacing between adjacent tile units (e.g., a first tile unit and a second tile unit, as shown in FIG. 4) on a foundation surface (e.g., a wall, the ground, etc.) includes a body portion 10, one or more first through-holes 20, and one or more second through-holes 30.

In some embodiments, body portion 10 may include a first end 16 and a second end 18 and at least one external side surface 14 (e.g., side surfaces of a rectangular prism) extending between first end 16 and second end 18. In some embodiments, the at least one external side surface 14 may be substantially parallel to a longitudinal axis 15 of body portion 10.

For the purposes of this specification, the phrase "external side surface" shall be defined to mean any external surface of the linear spacer which extends between the first end 16 and second end 18, and not including the surfaces of first end 16 and second end 16. In the embodiment of FIG. 1, the "at least one external side surface 14" includes the four sides of the rectangular prism shape of the linear spacer 100 that extend between first end 16 and second end 18. In other embodiments, such as the cylindrically shaped linear spacer 100*c* of FIG. 9A, the "at least one external side surface 14" includes the surface area of the cylinder that extends from first end 16 to second end 18 (i.e., there is a single "external side surface"). In other embodiments, for example, an embodiment of a linear spacer which has a hexagonal cross-sectional shape (see, e.g., cross-sectional shape 36*e* of FIG. 8B), the "at least one external side surface 14" would include the 6 sides of the hexagonally shaped linear spacer extending from first end 16 to second end 18.

In some embodiments, the one or more first through-holes 20 may extend through body portion 10 in a first direction (e.g., along the z-axis of FIG. 1) substantially orthogonal to longitudinal axis 15 and extending from a first external opening 22 on the at least one external side surface 14 of body portion 10 to opposing second external opening 24 on at least one external side surface 14 of the body portion 10.

In some embodiments, the one or more second through-holes 30 may extend through body portion 10 in a second direction (e.g., along the y-axis of FIG. 1) different than the first direction and orthogonal to longitudinal axis 15 and extending from a third external opening 32 (on the face of body portion 10 facing out of the page in FIG. 1) on at least one external side surface 14 of body portion 10 to an opposing fourth external opening 34 (on the face of body portion 10 facing away, into the paper, in FIG. 1) on at least one external side surface 14 of body portion 10.

In some embodiments, at least one of the one or more first through-holes 20 (e.g., first through-hole 20*a*) may intersect at least one of the one or more second through-holes 30 (e.g., second through-hole 30*a*) such that the at least one first through-hole 20*a* and the at least one second through-hole 30*a* define a common open space 50 within the body portion 10 of the linear spacer 100 which is contained/included in both first through-hole 20*a* and second through-hole 30*a*.

Figure 2A:
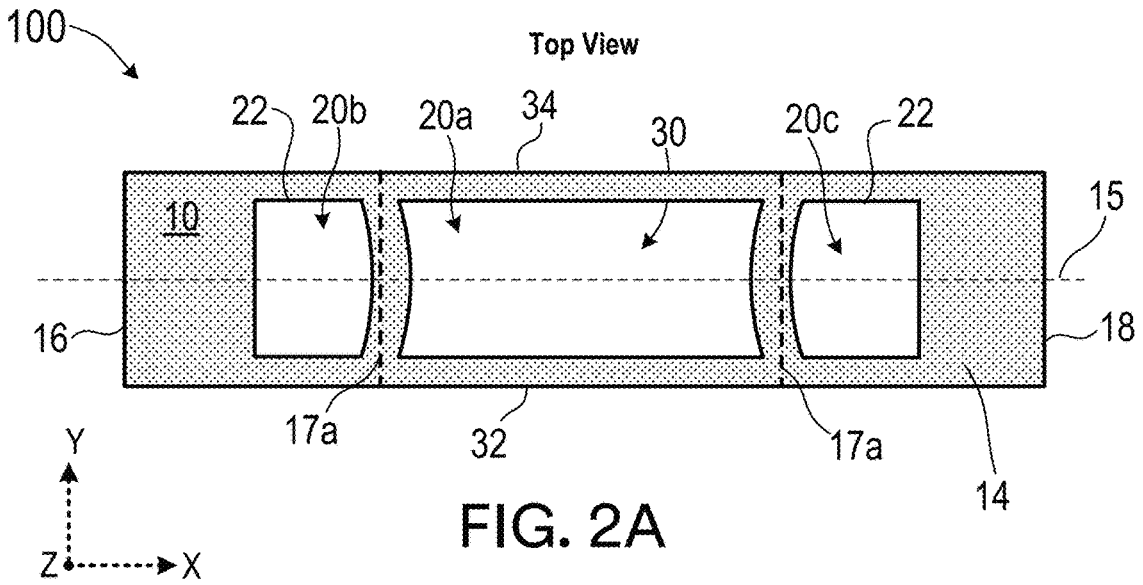
FIGS. 2A and 2B are top and side views, respectively, of a linear spacer, in accordance with the first embodiment of the present description.
Figure 2B:
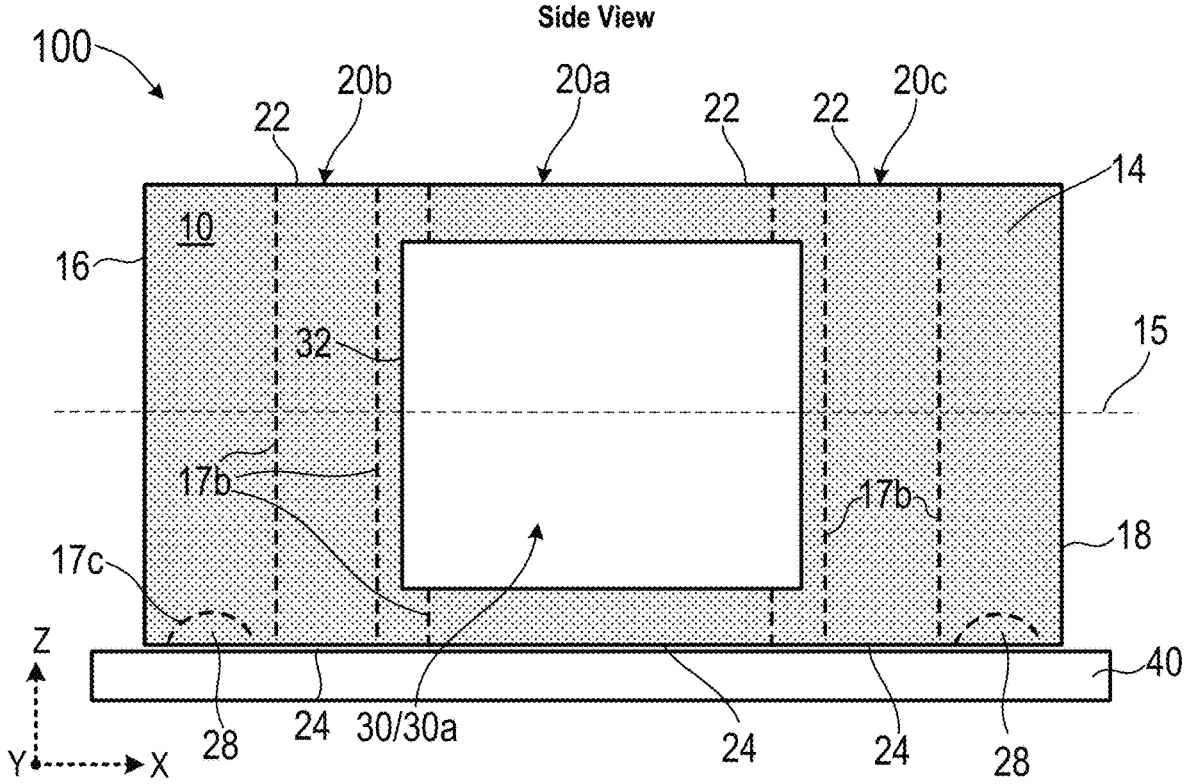

FIGS. 2A and 2B are top and side views, respectively, of an embodiment of a linear spacer, such as the embodiment of linear spacer 100 of FIG. 1. FIGS. 2A and 2B share features with FIG. 1 and therefore like-numbered components in FIGS. 2A and 2B shall be assumed to have the same function as the corresponding components of FIG. 1 unless otherwise specified herein, and thus additional description may not be given for these components in the following discussion.

Looking first at FIG. 2A, showing a top view of linear spacer 100, one or more first through-holes 20 (including first through-holes 20*a*, 20*b*, and 20*c*) are shown extending down through body portion 10 from first external opening 22. It should be noted that the exact number of first through-holes 20 shown in FIG. 2A, as well as their specific shape/design, is one example only and is not intended to be limiting. For example, in some embodiments, the number of first through-holes 20 may be 1, or 2, or 3, or 4, or 5, or any appropriate number of first through-holes. The first through-holes 20 serve the function of allowing grout material to enter into and pass through the hollow spaces defined by first through-holes 20 to allow sufficient adhesion between the grout and the foundation surface (e.g., a wall, such as surface 40 in FIG. 2B) beneath.

Vertical dashed lines in FIG. 2A 17*a* show the extent of second through-hole 30 which passes from third external opening 32 through body portion 10 to fourth external opening 34. In some embodiments, first through-holes 20 may intersect and/or be centered on longitudinal axis 15.

Turning now to FIG. 2B, showing a side view of linear spacer 100, one or more second through-holes 30*a* are shown extending back through body portion 10 from third external opening 32. Dashed vertical lines 17*b* show the extent of first through-holes 20 (including 20*a*, 20*b*, and 20*c*). As with first through-holes 20, the number of second through-holes 30 is not intended to be limiting. For example, in some embodiments, the number of second through-holes 30 may be 1, or 2, or 3, or 4, or 5, or any appropriate number of second through-holes. Similar to first through-holes 20, second through-holes 30 serve the function of allowing grout material to enter into and pass through the hollow spaces defined by second through-holes 30 to allow sufficient adhesion between the grout and the tile units on either side of the linear spacer (see, e.g., FIG. 4). In some embodiments, second through-holes 30 may intersect and/or be centered on longitudinal axis 15.

Near the bottom edge of FIG. 2B, additional, curved dashed lines 17*c* show the extent of concave depressions 28 that may appear on an exterior surface 14 of linear body 10. These depressions may be any appropriate shape and number and serve the purpose of allowing space for grout between the external side surface 14 (and, in some embodiments, a downward-facing surface, facing the foundation surface) and foundation surface 40 to which the linear spacer 100 may be adjacent. Additional details on depressions 28 are provided elsewhere herein.

Figure 3A:
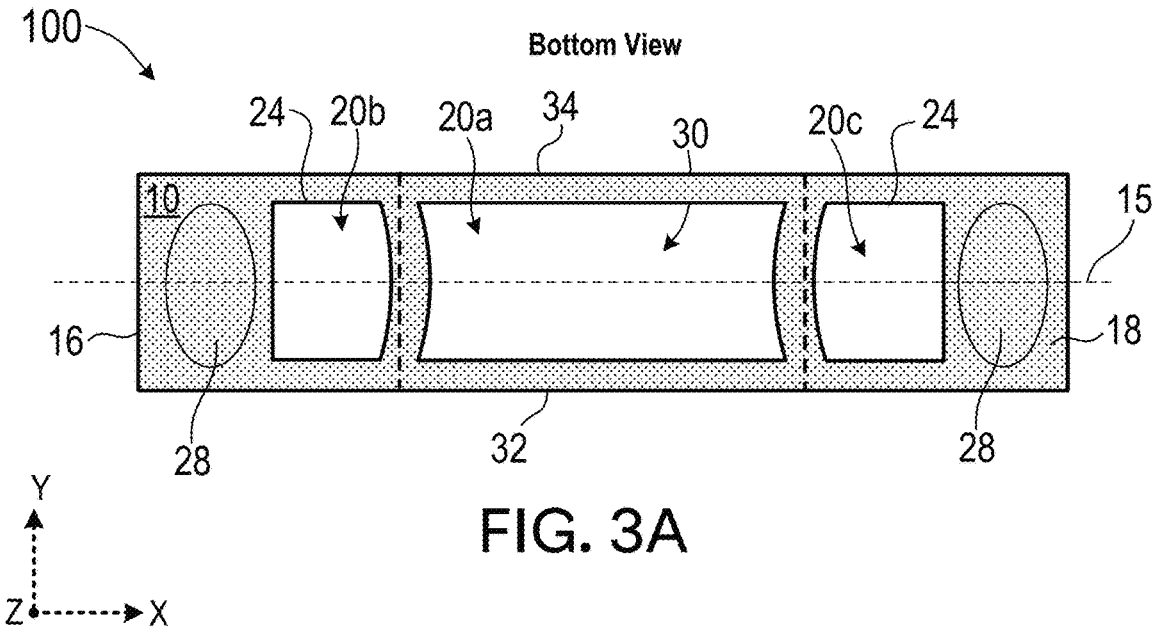
FIGS. 3A and 3B are bottom and cutaway side views, respectively, of a linear spacer, in accordance with the first embodiment of the present description.
Figure 3B:
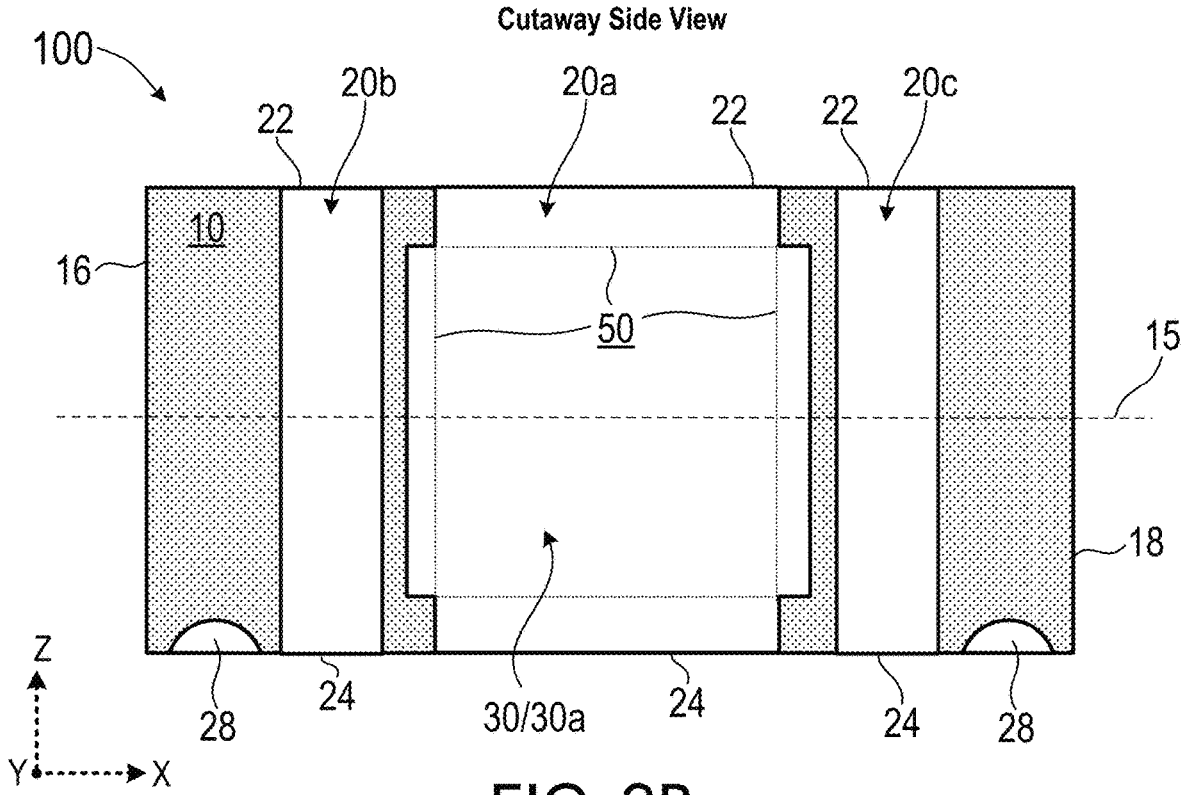

FIGS. 3A and 3B are bottom and cutaway side views, respectively, of an embodiment of a linear spacer, such as the embodiment of linear spacer 100 of FIGS. 1, 2A, and 2B. FIGS. 3A and 3B share features with FIGS. 1, 2A, and 2B and therefore like-numbered components in FIGS. 3A and 3B shall be assumed to have the same function as the corresponding components in preceding figures unless otherwise specified herein, and thus additional description may not be given for these components in the following discussion.

Turning to FIG. 3A, the "bottom view" shows additional detail of depressions 28. It should be noted that, for the purposes of this discussion, the "bottom" surface of linear spacer 100 shall be assumed to be any surface (whether planar, curved, or other) that, in use, substantially faces the foundation surface (e.g., wall, ground, etc., such as foundation surface 40 in FIG. 2B) to which the tile units are being attached or placed. These depressions 28 on the bottom surface of linear spacer 100 allow grout/adhesive material which has been placed on the foundation surface to extend up into linear body 10, providing additional adhesion between linear body 10 and the foundation surface. The number and/or shapes of depressions 28 shown herein are not intended to be limiting, and any appropriate shape or number of depressions 28 is considered within the scope of the present description.

FIG. 3B is a cutaway, side view of linear spacer 100, where linear spacer 100 has been cut substantially along longitudinal axis 15 (e.g., along axis 15 shown in FIG. 3A). This cutaway view provides details of the interiors of depressions 28, as well as first through-holes 20 (20*a*, 20*b*, and 20*c*) and second through-holes 30. The view of FIG. 3B also shows common open space 50 within body portion 10 of linear spacer 100 which is created by both first through-hole 20*a* and second through-hole 30*a* through body portion 10. Dotted lines have been added to FIG. 3B to better define the common (shared) open space 50 where first through-hole 20 intersects with second through-hole 30.

FIG. 4 is a schematic view of an embodiment of a linear spacing system 400 including one or more linear spacers 100 creating uniform spacing between tile units on a foundation surface, according to the present description. FIG. 4 shows four tile units including first tile unit 70*a*, second tile unit 70*b*, third tile unit 70*c*, and fourth tile unit 70*d* (together referenced as "tile units 70") disposed on a foundation surface 40 (e.g., a wall of a kitchen). In practice, an adhesive material 44 may be applied to foundation surface 40, and tile units 70 may be pressed into adhesive material 44. To ensure uniform spacing between adjacent tile units, linear spaces 100 are positioned between adjacent tile units 70*a* and 70*b*, between adjacent tile units 70*a* and 70*c*, between adjacent tile units 70*b*, and 70*d*, and between adjacent tile units 70*c* and 7*d*. Linear spacers 100 may also be pressed into adhesive material 44 between adjacent tile units. It should be noted that, in some embodiments, adhesive material 44 and grout material 42 may be the same material.

It should also be noted that any particular length of section of linear spacing system 400 may be formed from a single, integrally formed linear spacer 100, or from two or more linear spacers 100 placed together end-to-end to form the required length. For example, in some embodiments, linear spacer 100 of FIG. 1 may be a single, unitary piece of any required length, for example, about 4 inches long, about 8 inches long, about 12 inches long, about 2 feet long, about 4 feet long, about 8 feet long, or about 10 feet long. If embodiments where linear spacer 100 is a single, integral piece and has a relatively longer length (e.g., the length of a tile or a wall), the pattern of through-holes 20, 30 and other features shown in FIG. 1 may be repeated over the length of the extended linear spacer 100. In other embodiments, linear spacing system 400 may be formed to the desired length by placing two or more linear spacers 100 together. Adjustable length spacing systems are described elsewhere herein.

In some embodiments, a length for linear spacing system 400 may be determined by the length of the gap between adjacent tile units or between adjacent pluralities of tile units (e.g., adjacent rows or columns of tile units). In some embodiments, for example, the length of the linear spacing system 400 may be substantially equal to the length of the gap between adjacent tile units. When a length of linear spacing system 400 is substantially equal to the length of the gap between adjacent tile units, or to the gap between adjacent pluralities of tile units, the linear spacing system 400 provides optimum uniform spacing along the entire gap. Stated another way, the more of the gap that is filled with the linear spacing system 400, the less likelihood of the adjacent tile units "skewing" or rotating relative to one another on foundation surface 40. In some embodiments, the linear spacing system 400 may cover at least 50%, or at least 60%, or at least 70%, or at least 80%, or at least 90%, or at least 100%, or at least 110% of the gap between tile units.

Figure 5A:
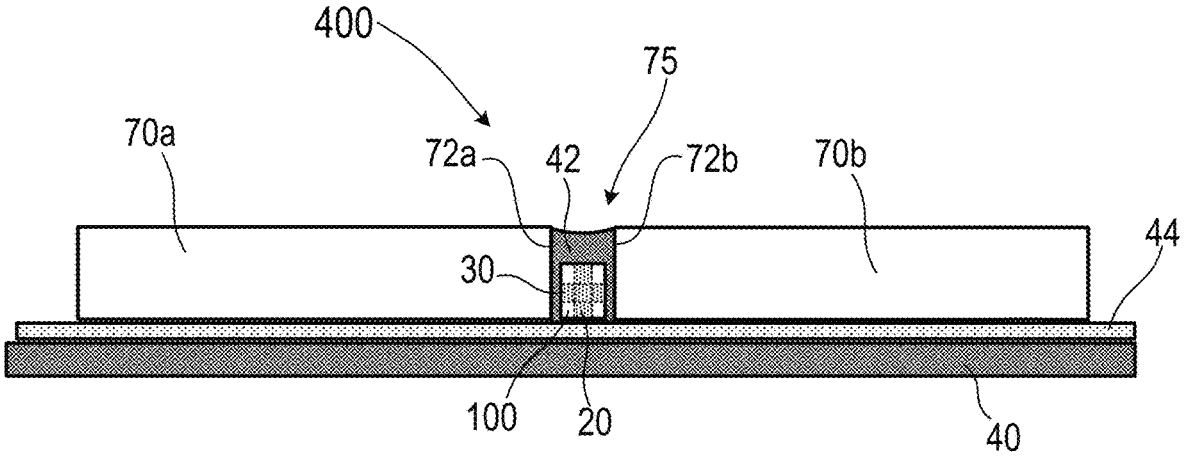
FIGS. 5A and 5B are edge views of a linear spacing system embedded in grout between adjacent tiles, in accordance with an embodiment of the present description.
Figure 5B:
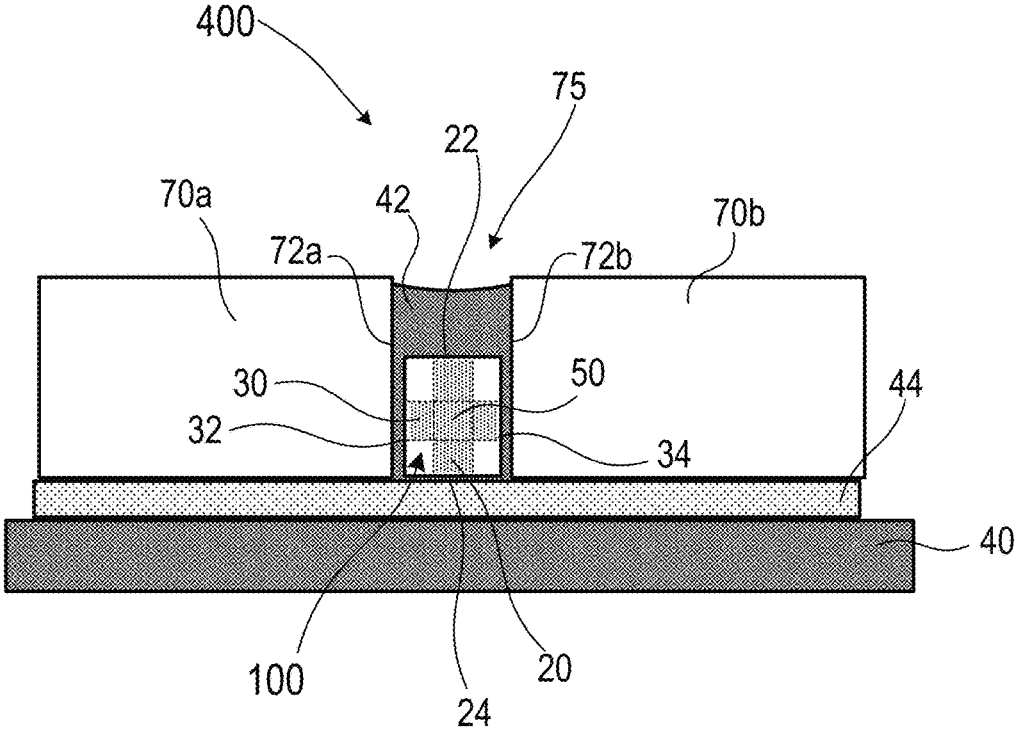

FIGS. 5A and 5B show edge views of the embodiment shown in FIG. 4 of linear spacing system embedded in grout between adjacent tiles. FIG. 5B is an enlarged view of the center portion of FIG. 5A, showing details more clearly.

In some embodiments, when linear spacer 100 is disposed in a gap 75 between first tile unit 70*a* and second tile unit

70*b* such that third external opening 32 is substantially adjacent to a first edge 72*a* of first tile unit 70*a*, fourth external opening 34 is substantially adjacent to a corresponding first edge 72*b* of second tile unit 70*b*, second external opening 24 is adjacent foundation surface 40, and first external opening 22 faces substantially away from foundation surface 40, linear spacer 100 defines and maintains a linear spacing between first tile unit 70*a* and second tile unit 70*b*.

In some embodiments, linear spacer 100 may be embedded in and surrounded by grout material 42 placed in gap 75 between first tile unit 70*a* and second tile unit 70*b*. In some embodiments, grout material 42 may extend into first through-holes 20 and second through-holes 30, and may, in some embodiments, at least partially fill common open space 50 where first through-hole 20 intersects second through-hole 30. In some embodiments, grout material 42 and adhesive material 44 may be the same material. In other embodiments, grout material 42 and adhesive material 44 may be different materials.

An advantage over the embodiments described herein over the prior art includes the fact that linear spacers 100 are intended to extend over a substantial portion of the gap between adjacent tile units. As shown in FIG. 4, linear spacers 100 extend over and beyond the entire length of the gap between adjacent tile units (e.g., the vertical gap between first tile unit 70*a* and second tile unit 70*b*, or the horizontal gap between first tile unit 70*a* and third tile unit 70*c*). In some embodiments, a length of linear spacer 100 may be greater than or equal to about 50%, or greater than or equal to about 60%, or greater than or equal to about 70%, or greater than or equal to about 80%, or greater than or equal to about 90%, or greater than or equal to about 100%, or greater than or equal to about 110% of a length of the gap between the first tile unit and the second tile unit. In some embodiments, the length of the linear spacer 100 may extend beyond the length of two adjacent tile units. For example, the linear spacer 100 may extend across the entire width/height of the foundation surface 40 to define a spacing between all of the adjacent tiles along the width/height of foundation surface 40.

Figure 6A:
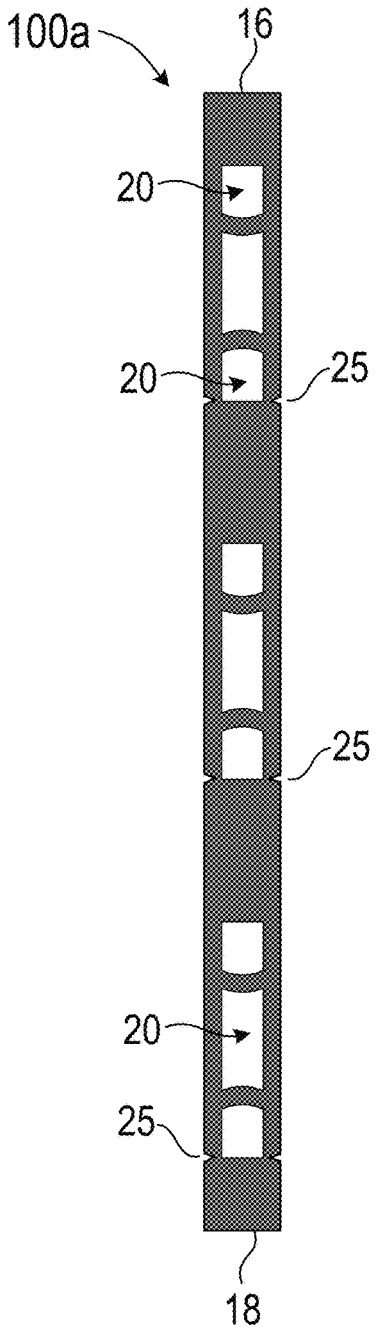
FIGS. 6A and 6B are views of variations of an adjustable-length linear spacer, in accordance with embodiments of the present description.
Figure 6B:
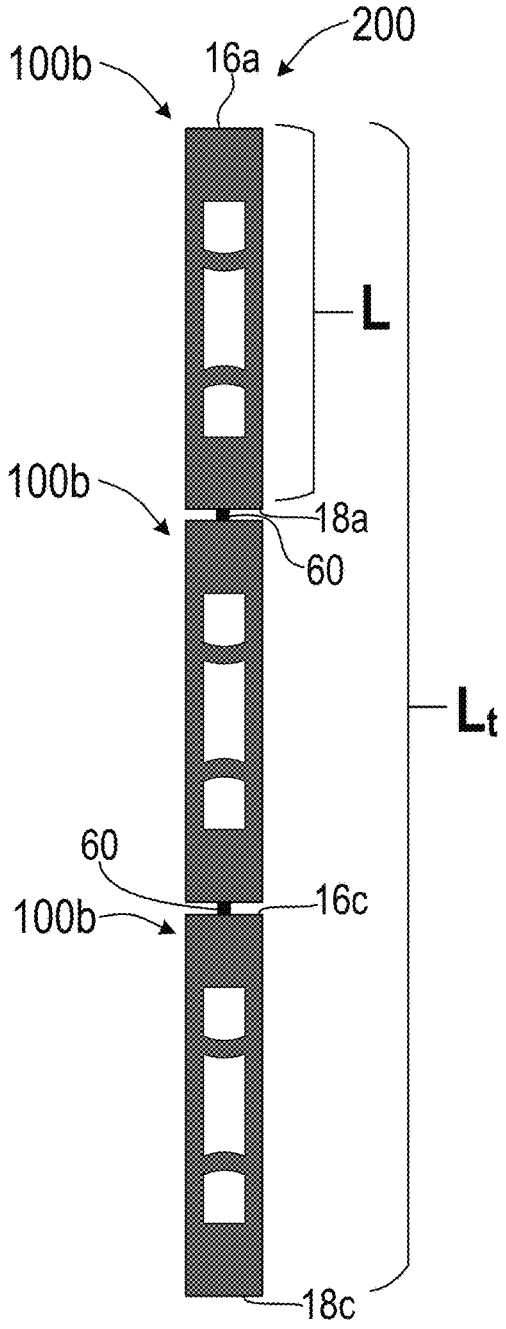

As walls, patios, etc., being tiled or paved are necessarily of different dimensions, it is desirable to have a linear spacer that has an adjustable length to accommodate any number of such dimensions. FIGS. 6A and 6B illustrate alternate embodiments of an adjustable-length linear spacing system, according to the present description.

In the embodiment of FIG. 6A, linear spacer 100*a* is a single, integral piece that has been configured (e.g., molded, machined, or otherwise produced) to have a longer overall length from first end 16 to second end 18 (e.g., the length of 3 linear spacers 100 of FIG. 1). In one example, the linear spacer 100*a* may be produced in lengths of, for example, 4 inches, 8 inches, 1 foot, 2 feet, 3 feet, 5 feet, 10 feet, or any appropriate length. In such embodiments, linear spacer 100*a* may be shortened to accommodate shorter distances as needed. For example, linear spacer 100*a* may include score features 25 at set intervals along the overall length of linear spacer 100*a*. In use and as needed, a user could apply pressure on either side or both sides of the score feature 25 to "snap" linear spacer to the desired shorter length.

In the alternate embodiment of an adjustable length linear spacing system shown in FIG. 6B, the overall length of the linear spacer may be defined by assembling a plurality of smaller linear spacers 100*b* end-to-end, connected and aligned to each other by an alignment feature 60. In the embodiment shown in FIG. 6B, three linear spacers 100*b* are connected to make a single adjustable-length linear spacing system 200. That is, while the length of a single linear spacer 100*b* L is defined as the distance from its first end to its second end (e.g., from first end 16*a* to second end 18*a* for the top-most linear spacer 100*b*), the total length Li of linear spacing system 200 is defined by the distance from first end 16*a* of the top-most linear spacer 100*b* to the second end 18*c* of the bottom-most linear spacer 100*b*. Top-most and bottom-most refer here to the top and bottom of the page containing the figures. Example alignment feature may include mating male and female end features, separate connectors, etc., as further defined in FIGS. 7A-7C.

Figure 7A:
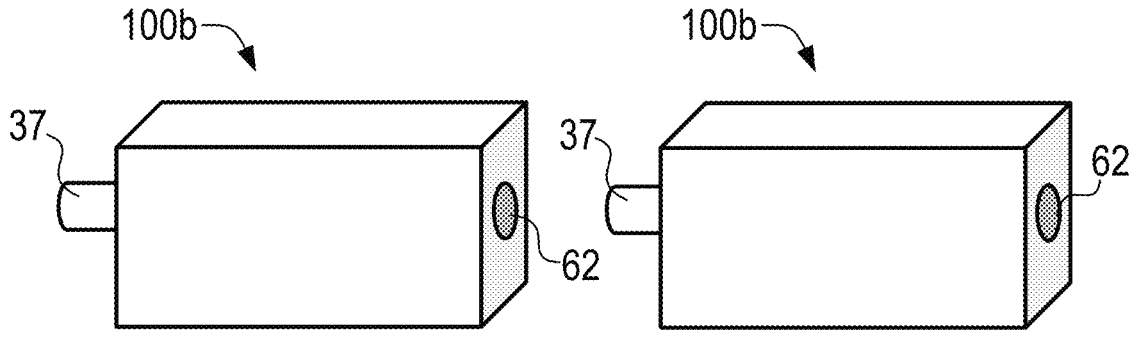
FIGS. 7A-7C depict various features for connecting two adjacent linear spacers, in accordance with an embodiment of the present description.
Figure 7B:
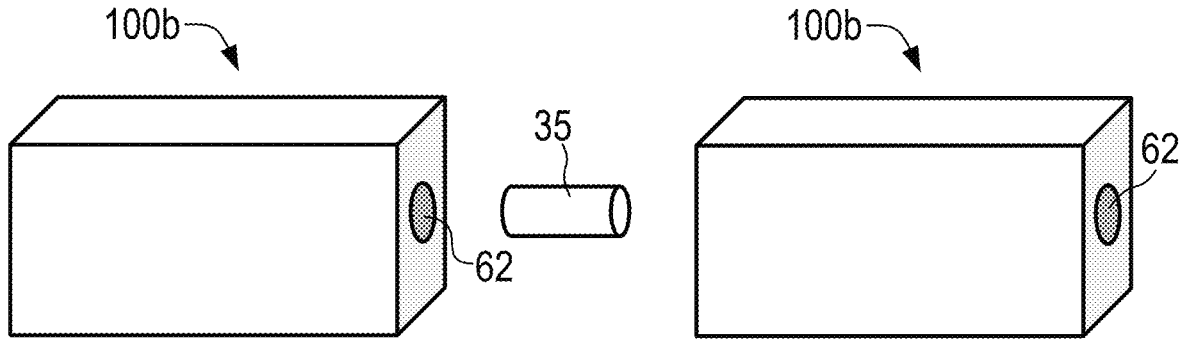
Figure 7C:
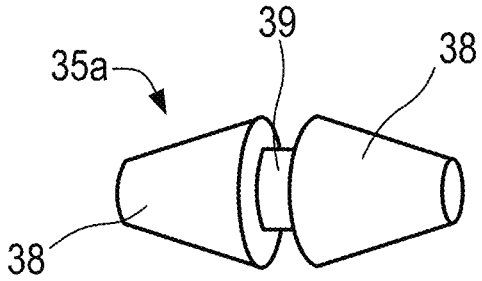

FIGS. 7A-7C depict various embodiments of alignment features for connecting two adjacent linear spacers to produce an adjustable length linear spacer, according to the present description. In the embodiment of FIG. 7A, two shorter linear spacers 100*b* may be connected by an alignment feature which includes a female receptacle 62 at one end of a linear spacer 100*b* and an integral mating male projection 37 at an opposite end of linear spacer 100*b*. In some embodiments, these alignment features 62 and 37 may be configured such that they lock together when fully engaged. It should be noted that the linear spacers 100*b* shown in FIGS. 7A-7B are simplified (block) versions for the purposes of discussing the alignment features and do not show elements such as the through-holes and depressions discussed elsewhere herein.

In the embodiment of FIG. 7B, two or more linear spacers 100*b* may include female features 62 (e.g., receptacle or hole) on both, opposing ends and may be joined together by an alignment feature in the form of a separate connector (connecting member) 35. In some embodiments, connecting member 35 may be configured/shaped such that it locks in place when pressed into female features 62 between adjacent linear spacers 100*b*. For example, connecting member 35 may have a shape similar to connector 35*a* shown in FIG. 7C, which has conical ends 38 separated by a smaller "waist" 39 between the conical ends 38 (which could engage with the female features 62 once the conical ends have been pushed far enough into linear spacers 100*b*). In some embodiments, the base (larger end) of conical ends 38 of connector 35*a* may be sized to be at least slightly larger than female feature 62 such that conical ends 38 must be compressed when pushed into female feature 62, until the entire conical end 38 is pushed through female feature 62 and allowed to expand again, holding it in place inside female feature 62. In some such embodiments, connector 35*a* (or at least conical ends 38) may be constructed of a material which is flexible enough (e.g., a rubber or a soft plastic) to compress when it is pushed far enough into female feature 62.

The embodiments of linear spacers shown thus far in this description have been primarily shaped as rectangular prisms. However, the linear spacers (and, in particular, the cross-sectional shape of the linear spacers cut in a plane orthogonal to longitudinal axis 15) may be any appropriate shape. For example, FIGS. 8A and 8B depict various cross-sectional shapes for an embodiment of a linear spacer, according to the present description.

Figure 8A:
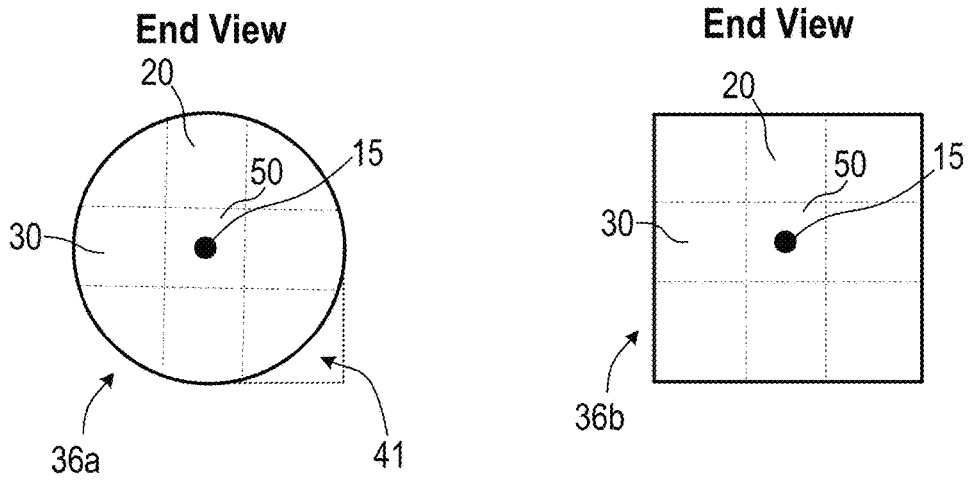
FIGS. 8A and 8B are cross-sectional views of various shapes for a linear spacer, in accordance with an embodiment of the present description.

FIG. 8A shows a round cross-sectional shape 36*a* (left) and a square or rectangular cross-sectional shape 36*b* (right). Both shapes can provide a similar spacing between adjacent tile units and support first through-holes 20 and second through-holes 30. Dashed lines show one embodiment of the placement of through-holes 20 and 30, as well as the common open space 50 they may define therebetween. It should also be noted that the round shape 36*a* may allow an extra void 41 which would allow an additional amount of grout material 42 (e.g., see grout material 42 in FIGS. 5A-5B) to flow into void 41, which may better secure the linear spacer between the tile units.

Figure 8B:
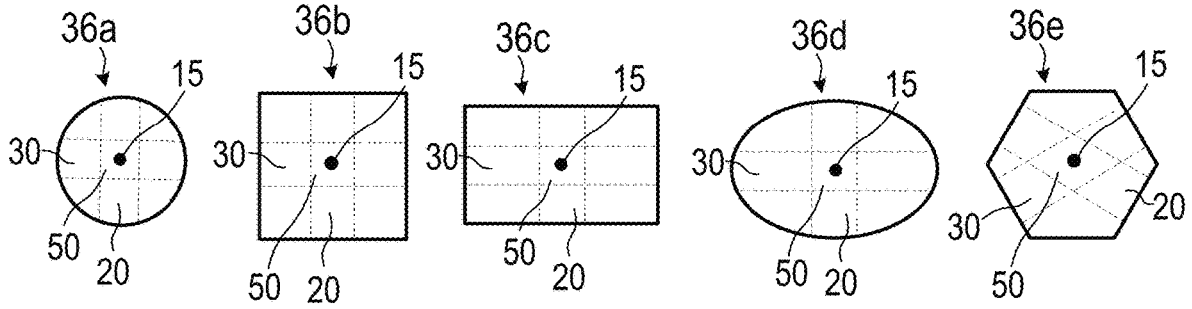

FIG. 8B shows a variety of cross-sectional shapes that may be appropriate for the linear spacers and fit within the scope of the present description, including round shape 36*a*, square shape 36*b*, rectangular shape 36*c*, oval or elliptical shape 36*d*, and hexagonal shape 36*e*. These shapes are not meant to be limiting, and any appropriate shape may be used within the scope of the present disclosure. It should be noted that shapes such as 36*a*, 36*d*, and 36*e* may even offer some advantages over straight-sided cross-sectional shapes such as 36*b* and 36*c*. For example, the shapes with rounded or angled sides may provide additional areas for grout material to flow when the linear spacers are placed between adjacent tiles. For example, the space marked 41 in FIG. 8A on the round cross-section is an open area that is not present when the linear spacer has a square or rectangular shape. Minimizing the volume of the gap between tile units which contains the linear spacer while maximizing the amount of grout in the gap may provide additional adhesion between linear spacer and tile units.

Figure 9A:
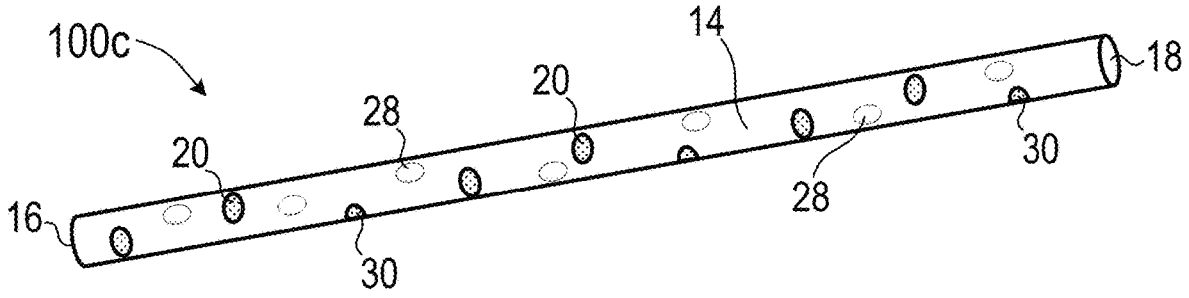
FIGS. 9A and 9B are a perspective view and a cross-sectional view, respectively, of a linear spacer, in accordance with an alternate embodiment of the present description.
Figure 9B:
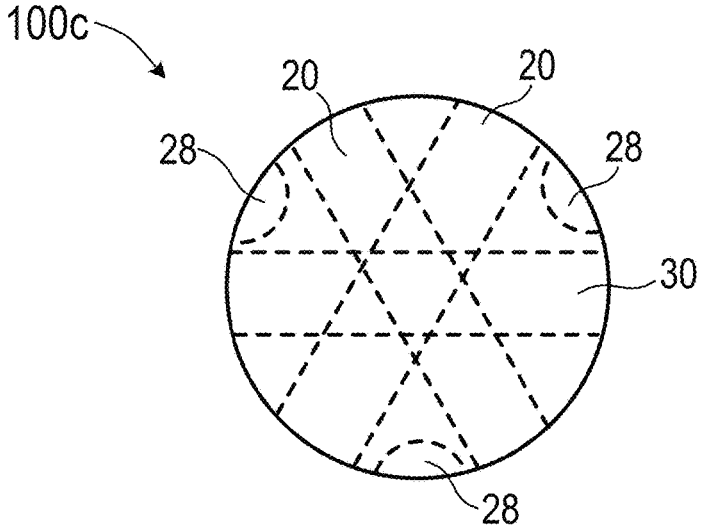

FIGS. 9A and 9B illustrate one embodiment of a linear spacer with a rounded cross-sectional shape. Linear spacer 100*c* of FIG. 9A may have an elongated cylindrical shape (similar to a pencil) extending from first end 16 to second end 18. In some embodiments, linear spacer 100*c* may have any number of first through-holes 20 and second through-holes 30 (and, notably, first through-holes 20 and second through-holes 30 may be substantially identical beyond individual placement and orientation), as well as any number of depressions 28 along exterior surface 14 of linear spacer 100*c*. As linear spacer 100*c* has a rounded cross-sectional shape, there is no defined "bottom" surface and therefore no incorrect orientation of linear spacer 100*c*. That is, the cylindrical shape of linear spacer 100*c* means that the linear spacer 100*c* may be rolled such that any part of seamless, corner-less exterior surface 14 may be considered to be the "bottom" surface. The placement of through-holes 20 and 30 and depressions 28 may be random or spaced periodically along exterior surface 14 of linear spacer 100*c*. For example, in the end view of linear spacer 100*c* shown in FIG. 9B, first through-holes 20 and second through-holes 30 may be oriented at various angles to each other (e.g., every 120 degrees of the circular shape) and at various locations between first end 16 and second end 18. Any placement of linear spacer 100*c* would be a "correct" orientation, as the location of through-holes and depressions is varied across exterior surface 14. By contrast, a linear spacer (e.g., linear spacer 100 of FIG. 1) with a square or rectangular cross-section can be considered to have a "top" surface (e.g., that featuring first external opening 22 and facing away from foundation surface 40, see FIG. 2B) and a "bottom" surface (e.g., that featuring second external opening 24 and facing foundation surface 40).

Figure 10:
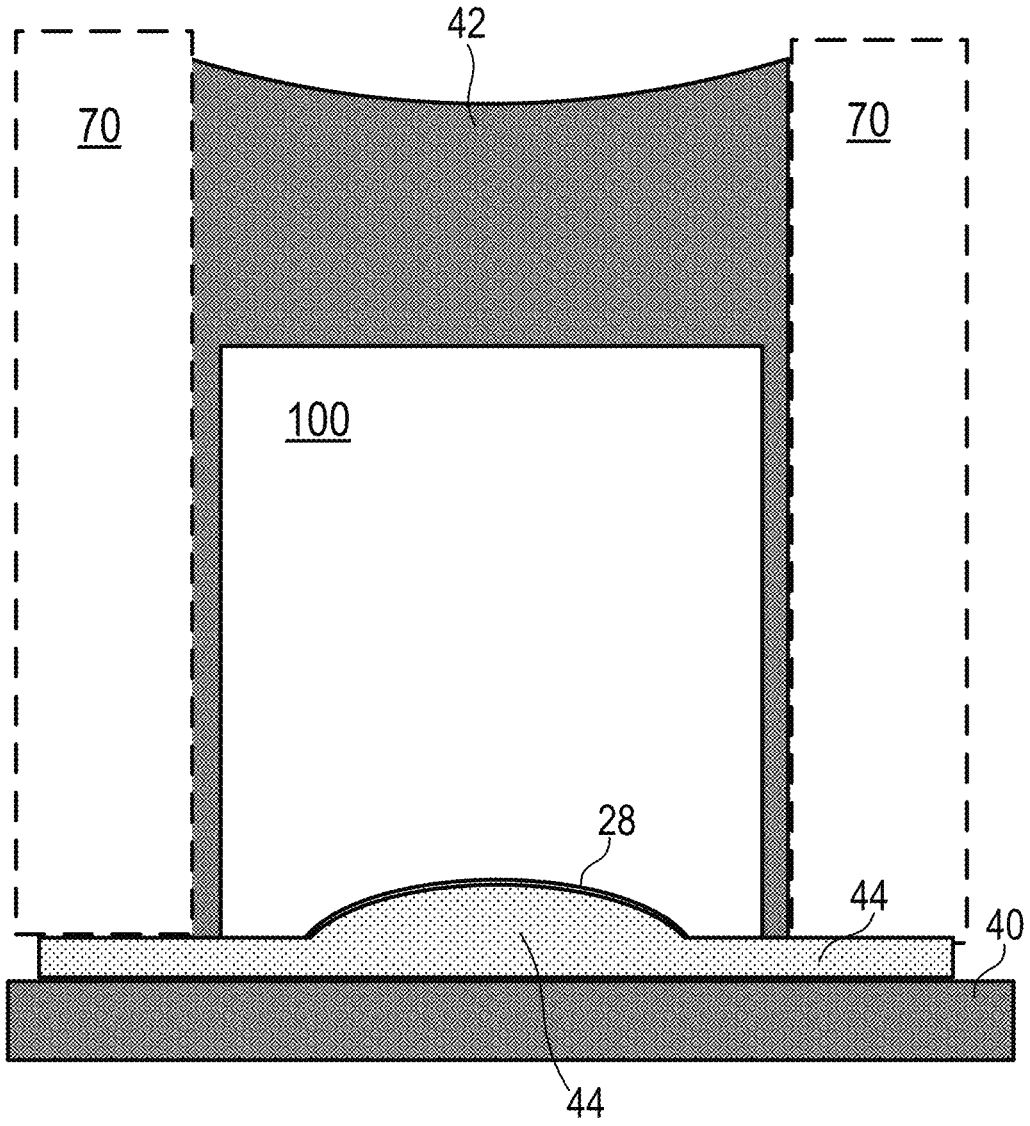
FIG. 10 is a cross-sectional view of an embodiment of a linear spacer showing additional details on a depression feature, in accordance with an embodiment of the present description.

Finally, FIG. 10 provides a cutaway, edge view with additional details of the embodiment of a depression feature 28 of a linear spacer 100, according to the present description (e.g., a cutaway view of the edge view shown in FIGS. 5A and 5B). This cutaway view is taken at a plane orthogonal to linear axis 15 (see previous figures) such that the interior of depression 28 is visible. When linear spacer 100 is placed between adjacent tiles 70, pressed into adhesive material 44 and surrounded by and embedded within grout material 42, the adhesive material 44 is allowed to pass up into depression 28, allowing additional adhesive 44 to provide adhesion between linear spacer 100 and foundation surface 40.

It should be noted that, while the figures herein may show a small amount of grout material 42 between linear spacer 100 and tile units 70 (e.g., along the sides of linear spacer 100 facing or adjacent to tile units 70), in practice, there may be substantially no or very little grout 42 between linear spacer 100 and the adjacent edge of tile units 70. The through-holes (such as through-hole 30 of at least FIG. 1) allow the grout material to pass into the open spaces thus defined within linear spacer 100, and the sides of linear spacer are substantially in contact with the edges of tile units 70.

Terms such as "about" will be understood in the context in which they are used and described in the present description by one of ordinary skill in the art. If the use of "about" as applied to quantities expressing feature sizes, amounts, and physical properties is not otherwise clear to one of ordinary skill in the art in the context in which it is used and described in the present description, "about" will be understood to mean within 10 percent of the specified value. A quantity given as about a specified value can be precisely the specified value. For example, if it is not otherwise clear to one of ordinary skill in the art in the context in which it is used and described in the present description, a quantity having a value of about 1, means that the quantity has a value between 0.9 and 1.1, and that the value could be 1.

Terms such as "substantially" will be understood in the context in which they are used and described in the present description by one of ordinary skill in the art. If the use of "substantially equal" is not otherwise clear to one of ordinary skill in the art in the context in which it is used and described in the present description, "substantially equal" will mean about equal where about is as described above. If the use of "substantially parallel" is not otherwise clear to one of ordinary skill in the art in the context in which it is used and described in the present description, "substantially parallel" will mean within 30 degrees of parallel. Directions or surfaces described as substantially parallel to one another may, in some embodiments, be within 20 degrees, or within 10 degrees of parallel, or may be parallel or nominally parallel. If the use of "substantially aligned" is not otherwise clear to one of ordinary skill in the art in the context in which it is used and described in the present description, "substantially aligned" will mean aligned to within 20% of a width of the objects being aligned. Objects described as substantially aligned may, in some embodiments, be aligned to within 10% or to within 5% of a width of the objects being aligned.

All references, patents, and patent applications referenced in the foregoing are hereby incorporated herein by reference in their entirety in a consistent manner. In the event of inconsistencies or contradictions between portions of the incorporated references and this application, the information in the preceding description shall control.

Descriptions for elements in figures should be understood to apply equally to corresponding elements in other figures, unless indicated otherwise. Although specific embodiments have been illustrated and described herein, it will be appreciated by those of ordinary skill in the art that a variety of alternate and/or equivalent implementations can be substituted for the specific embodiments shown and described without departing from the scope of the present disclosure. This application is intended to cover any adaptations or variations of the specific embodiments discussed herein.

Therefore, it is intended that this disclosure be limited only by the claims and the equivalents thereof.

What is claimed:

1. A linear spacer for creating a uniform spacing between a first tile unit and a second tile unit disposed on a foundation surface, the linear spacer comprising:

a body portion comprising a first end and a second end and at least one external side surface extending between the first end and the second end and substantially parallel to a longitudinal axis of the body portion;

one or more first through-holes extending through the body portion in a first direction substantially orthogonal to the longitudinal axis and extending from a first external opening on the at least one external side surface of the body portion to an opposing second external opening on the at least one external side surface of the body portion; and one or more second through-holes extending through the body portion in a second direction different than the first direction and orthogonal to the longitudinal axis and extending from a third external opening on the at least one external side surface of the body portion to an opposing fourth external opening on the at least one external side surface of the body portion;

wherein, when the linear spacer is disposed in a gap between the first tile unit and the second tile unit such that the third external opening is substantially adjacent to a first edge of the first tile unit, the fourth external opening is substantially adjacent to a corresponding first edge of the second tile unit, the second external opening is adjacent the foundation surface, and the first external opening faces substantially away from the foundation surface, the linear spacer defines and maintains a linear spacing between the first tile unit and the second tile unit.

2. The linear spacer of claim 1, wherein the linear spacer is configured to be permanently embedded in a grout applied in the gap between the first tile unit and the second tile unit.

3. The linear spacer of claim 2, wherein, when the linear spacer is embedded in the grout, the grout is at least partially disposed within the one or more first through-holes and is in contact with the foundation surface to which the first tile unit and second tile unit are disposed.

4. The linear spacer of claim 2, wherein, when the linear spacer is embedded in the grout, the grout is at least partially disposed within the one or more second through-holes and is in contact with the first edge of the first tile unit and the corresponding first edge of the second tile unit.

5. The linear spacer of claim 1, wherein at least one of the one or more first through-holes intersects at least one of the one or more second through-holes, such that the at least one first through-hole and the at least one second through-hole define a common open space (50) within the body portion of the linear spacer.

6. The linear spacer of claim 1, wherein at least one of the one or more first through-holes intersects the longitudinal axis of the body portion.

7. The linear spacer of claim 1, wherein at least one of the one or more second through-holes intersects the longitudinal axis of the body portion.

8. The linear spacer of claim 1, wherein the second direction is substantially orthogonal to the first direction.

9. The linear spacer of claim 1, wherein at least one of the first end and the second end of the body portion comprises an alignment feature, the alignment feature configured to align and connect the linear spacer to a mating linear spacer.

10. The linear spacer of claim 9, wherein the alignment feature is a hole in the at least one of the first end and the second end of the body portion, the hole configured to accept a connecting member configured to align the linear spacer with the mating linear spacer.

11. The linear spacer of claim 10, wherein the connecting member is a separate piece designed to be disposed in the hole of the linear spacer and a corresponding hole in the mating linear spacer.

12. The linear spacer of claim 10, wherein the connecting member is a protrusion on an end surface of a mating linear spacer, the protrusion designed to be disposed in the hole of the linear spacer.

13. The linear spacer of claim 1, further comprising at least one depression in the at least one external side surface, wherein, when a grout is applied between the at least one depression of the linear spacer and the foundation surface, grout is allowed to pass into the at least one depression.

14. The linear spacer of claim 1, wherein the body portion further comprises one or more score features, the one or more score features defining locations where the body portion can be separated to reduce an overall length of the linear spacer.

15. The linear spacer of claim 1, wherein a cross-section of the body portion taken in a plane orthogonal to the longitudinal axis has a shape chosen from a group including a square, a rectangle, a circle, and oval, and a polygon.

16. The linear spacer of claim 1, wherein a length of the linear spacer is defined by a distance between the first end and the second end, and the length is greater than or equal to 50% of a length of the gap between the first tile unit and the second tile unit.

17. The linear spacer of claim 1, wherein a cross-section of the body portion taken in a plane orthogonal to the longitudinal axis has a substantially circular shape, and the one or more first through-holes and the one or more second through-holes are arranged along a length of the linear spacer defined by a distance between the first end and the second end and oriented at a variety of angles with respect to one another and the longitudinal axis.

18. The linear spacer of claim 17, further comprising a plurality of depressions in the at least one external side surface arranged at a plurality of different locations along the length of the linear spacer.

19. A linear spacing system comprising:

two or more linear spacers of claim 1; and one or more connectors configured to align and connect the two or more linear spacers end-to-end to create an adjustable length linear spacer.

20. The linear spacing system of claim 19, wherein the adjustable length linear spacer is configured to define and maintain a linear spacing between the first tile unit and the second tile unit, and a length of the adjustable length linear spacer is defined by a total length of the connected two or more linear spacers, and the length of the adjustable length linear spacer is greater than or equal to 50% of a length of the gap between the first tile unit and the second tile unit.

* * * * *